United States Patent [19]

Brandt et al.

[11] Patent Number: 4,615,670

[45] Date of Patent: Oct. 7, 1986

[54] ARRANGEMENT FOR MELTING SPINNING OF SYNTHETIC HIGH POLYMERS WITH MEANS FOR EXCHANGING NOZZLE SET

[75] Inventors: Holger Brandt, Ehndorf; Arnold Beck, Neumuenster; Joachim Dreyer, Aukrug-Bünzen, all of Fed. Rep. of Germany

[73] Assignee: Neumuenstersche Maschinen -und Apparatebau GmbH (NEUMAG), Neumuenster, Fed. Rep. of Germany

[21] Appl. No.: 709,779

[22] Filed: Mar. 11, 1985

[30] Foreign Application Priority Data

Mar. 15, 1984 [DE] Fed. Rep. of Germany ..... 3409530

[51] Int. Cl.[4] ..... D01D 4/08

[52] U.S. Cl. ..... 425/186; 29/426.5; 29/791; 29/823; 425/192 S

[58] Field of Search ..... 29/157 C, 426.5, 791, 29/823; 198/774; 414/225, 751; 901/17; 425/190, 192 S, 192, 191, 72 S, 186, 131.5; 264/39, 206

[56] References Cited

U.S. PATENT DOCUMENTS 4,196,049 4/1980 Burns et al. ..... 901/17

FOREIGN PATENT DOCUMENTS 2127278 12/1972 Fed. Rep. of Germany .
2718646 11/1978 Fed. Rep. of Germany .
2611940 10/1982 Fed. Rep. of Germany .
53-32556 3/1978 Japan .

*Primary Examiner*—Jay H. Woo
*Assistant Examiner*—J. Fortenberry
*Attorney, Agent, or Firm*—Michael J. Striker

[57] ABSTRACT

An arrangement for melt spinning of synthetic high polymers comprising a spinning bar, rails arranged at a height of a nozzle set inserted in the spinning bar, and a device for exchanging the spinning bars and including a carriage with an arm hydraulically moveable from an inclined inwardly directed normal position to a horizontal working position, wherein a free end of the arm is connected with a table serving for receiving of the exchangeable nozzle set and provided with elements for centering and securing of the dismounted nozzle set.

11 Claims, 6 Drawing Figures

ARRANGEMENT FOR MELTING SPINNING OF SYNTHETIC HIGH POLYMERS WITH MEANS FOR EXCHANGING NOZZLE SET

BACKGROUND OF THE INVENTION

The present invention relates to an arrangement for melt spinning of synthetic high polymers.

In melt spinning arrangements each spinning bar is provided with smaller or greater number of nozzle sets. Since nozzle sets and the filter for the nozzle sets have a service life of several days or several weeks, the exchange of the nozzle sets is an everyday routine work. The exchange of a nozzle set must disturb the spinning process with remaining nozzle sets as little as possible. The dismounted nozzle set has a temperature of approximately 200° C., and a new inserted nozzle set is preheated to a working temperature so as to be ready for operation very fast and do not cause local cooling of the spinning bar. The relatively high weight of the nozzle set and the unfavorable spatial conditions contribute to the fact that the exchange of the nozzle set cannot be performed in a completely simple and safe manner. Various auxiliary arrangements are used to make this working step simpler and more reliable.

One of such arrangements is disclosed in the German Pat. No. 2,611,940. Here a vertically movable hydraulically operated pulling rod structure is arranged under each nozzle set and has pulling rods provided with hooks for suspending the nozzle set. The cost of this arrangement is high in correspondence with the great number of the nozzle sets. Because of the poorly accessible arrangement above the spinning rod, the orderly observation and maintenance is difficult. It is known from practice to use for the exchange of nozzle sets hydraulic lever arrangements which are arranged in the blowing channel under the nozzle sets. With these arrangements, a narrow space for the required work is further reduced.

SUMMARY OF THE INVENTION

Accordingly, it is an object of the present invention to provide an arrangement for melt spinning of synthetic high polymers which avoids the disadvantages of the prior art.

More particularly, it is an object of the present invention to provide an arrangement for melt spinning of synthetic high polymers in which the exchange of nozzle sets is simpler and more reliable than in the known arrangements.

In keeping with these objects and with others which will become apparent hereinafter, one feature of the present invention resides, briefly stated, in an arrangement for melt spinning of synthetic high polymers in which rails are arranged parallel to a spinning bar, a carriage is movable on the rails, an arm mounted on the carriage is movable between a normal position and a working position, and a supporting element arranged on a free end of the arm moves in the working position to a nozzle set inserted in the spinning bar.

In the inventive arrangement only one auxiliary exchange means is needed. During the exchange of nozzle sets only the end of the arm provided with the supporting element extends in the blowing channel. The remaining part of the auxiliary means is located at a sufficient distance from the spinning bar, so that it does not interfere with the respective works.

In accordance with another feature of the present invention, the rails are located approximately at the height of the nozzle set, and the carriage is suspended on the rails. In this construction no standing surface is needed.

In accordance with still another advantageous feature of the present invention the arm is formed as a parallel guide with two links pivotally connected with the carriage and a connecting member connected with the supporting element. In this construction, the dismounted nozzle set is simultaneously lowered and moved out of the blowing channel and therefore held vertically in each position.

A further feature of the present invention is that the supporting element is arranged on a rod which is connected with the connecting member and is displaceable parallel to the latter. This allows an accurate positioning in a simple manner.

The connection between the supporting element and the rod is formed as an easily releasable connection. Therefore the supporting element is exchangeable, so that for different nozzle sets the respective supporting element can be used.

The supporting element and the nozzle set are provided with corresponding centering elements. This secures the nozzle set on the supporting element against lateral sliding.

The supporting element is provided with a table having at least one raised formation which corresponds to a depression at the lower side of the nozzle set. This construction provides for an especially simple arrangement.

The supporting element and the nozzle set are provided with corresponding locking elements. Therefore the nozzle set is secured against lifting and makes possible tearing off of the glued nozzle set during lowering.

The lower side of the nozzle set is provided with an undercut recess, and a hook bolt displaceable relative to the table is engageable in this recess. This construction is advantageous for the inventive arrangement.

The nozzle set is mounted by screws on the spinning bar and the table has openings for a tool releasing the screws, wherein the openings are blocked in a ready position and open in a locking position. These features contribute to the safety in that the releasing of the mounting screws of the nozzle set can be performed when the supporting element is orderly locked with the nozzle set.

The hook bolt is mounted on a plate slidingly guided relative to the table, and the plate is provided with openings which coincide with openings of the table only in the locking position.

The locking between the supporting element and the nozzle set is arrestable, so as to prevent unintentional releasing.

Finally, arresting pins are connected with the plate and selectively spring-engage in one of two openings of the table.

The novel features which are considered as characteristic for the invention are set forth in particular in the appended claims. The invention itself, however, both as to its construction and its method of operation, together with addit:onal objects and advantages thereof, will be best understood from the following description of specific embodiments when read in connection with the accompanying drawings.

DESCRIPTION OF THE PREFERRED EMBODIMENTS

Figure 1:
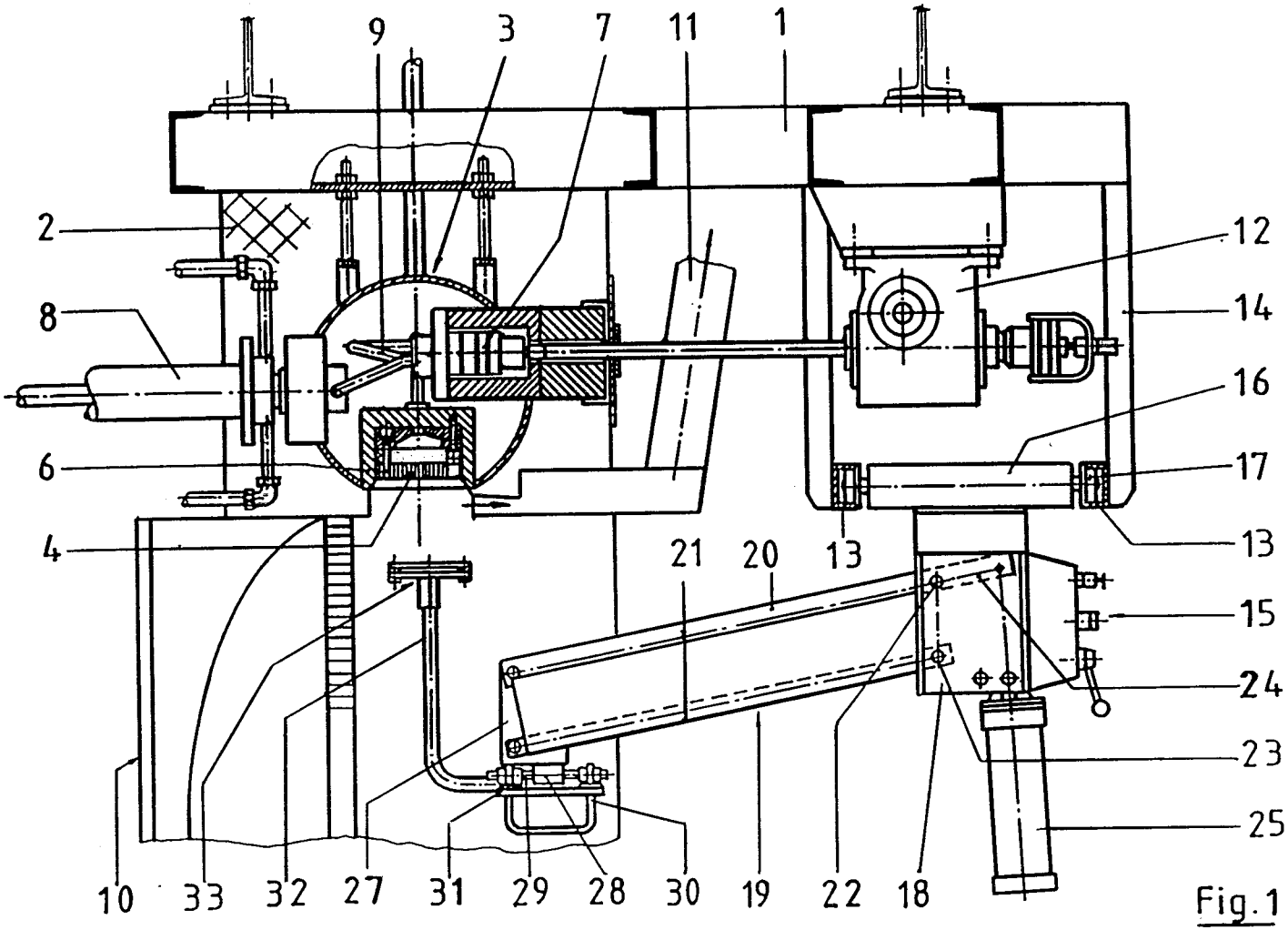
FIG. 1 is a view showing a section of an arrangement of melt spinning of synthetic high polymers in accordance with the present invention.

An arrangement for melt spinning of synthetic high polymers has a supporting structure 1 and a spinning bar 3 which is suspended on the support structure 1 and surrounded by an insulation casing 2. The spinning bar 3 is provided at its lower side with a plurality of nozzle sets 4 arranged in a row. The spinning bar 3 has a downwardly open chamber 6. The nozzle sets 3 are mounted in the chamber 6 of the spinning bar 3 by screws 5 which are screwed from below.

A spinning pump 7 is arranged at one side of the spinning bar 3, and a melt supplying conduit 8 is provided at the opposite side of the same. Melt guiding conduits 9 extend in the interior of the spinning bar. A blow channel 10 is located under the spinning bar 3. An inlet part of an aspiration passage 11 can be seen laterally under the nozzle set 4 in FIG. 1. The support structure 1 supports in addition to the spinning bar 3, also a drive 12 for the spinning pump 7.

Rails 13 are arranged parallel to the spinning bar 3 approximately at the height of the nozzle set 4. They are suspended on the support structure 1 with the aid of rods 14. Rails 13 extend over the entire length of the spinning bar 3 and extend at at least one point beyond the latter. The rails have a U-shaped cross-section and arranged so that their open sides face toward one another. A carriage 15 moves on the rails 13 and includes a chassis 16 with wheels 17 and a downwardly suspended box 18 with an arm 19 mountedon the box. The arm 19 is formed as a hinged parallelogram.

Figure 2:
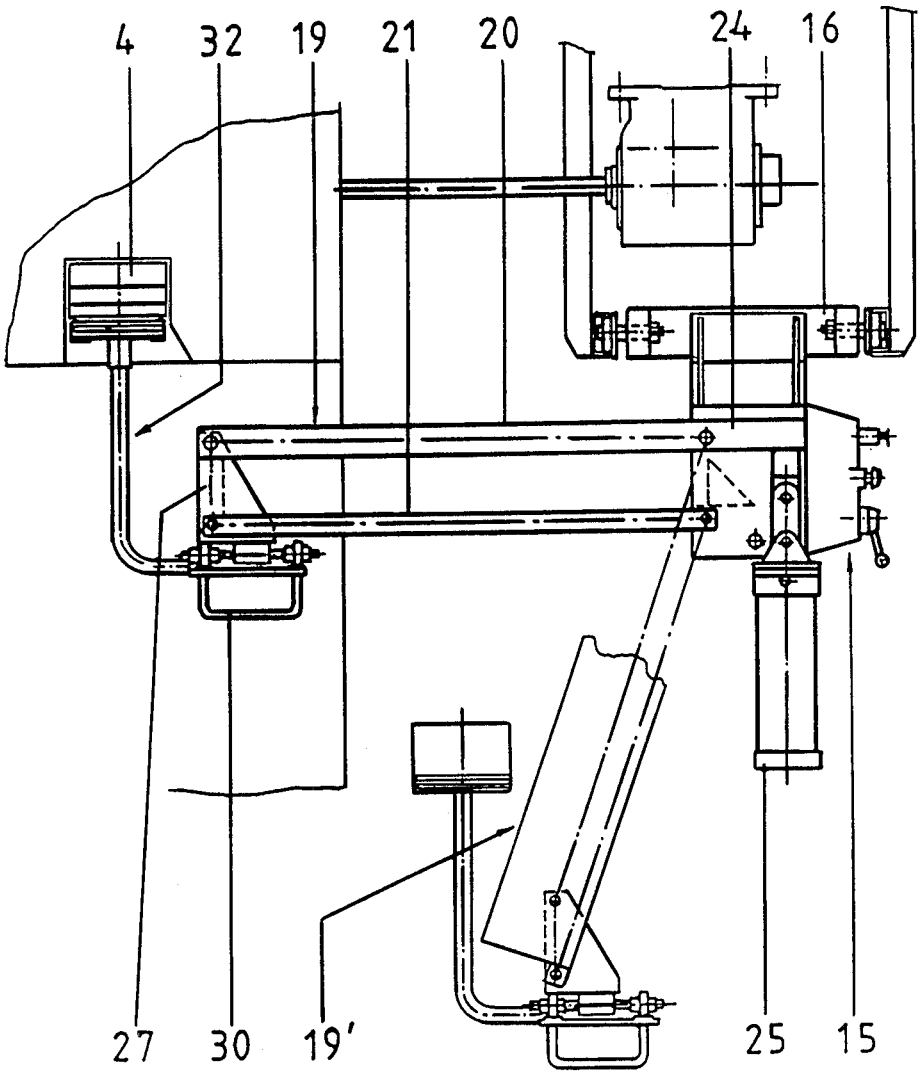
FIG. 2 is a view showing a device for exchanging nozzle sets of a spinning bar in a normal position shown in broken lines and in a working position shown in solid lines.

Two links 20 and 21 are pivotally connected with the box 18 and their pivot axles 22 and 23 are located vertically under one another. The upper link 20 is extended outwardly beyond the axle 22, so as to form a lever arm 24. A piston rod of an hydraulic cylinder-piston unit 25 pivotably connected with the box 18 engages the lever arm 24. With the aid of the hydraulic cylinder-piston unit 25, the arm 19 can be turned between a horizontal position directed toward the spinning bars 3, and a position at an acute angle to the first mentioned position in which the arm 19 extends somewhat downwardly. The horizontal position will be identified later on as a working position and it is shown in FIG. 2 in solid lines. The inclined downwardly directed position will be identified later on as a normal position and is shown in broken lines.

A lateral protective coating 26 is mounted on the lower link 21. The protective coating 26 extends in the working position to the upper link 20 and overlaps the latter in the normal position. A coupling member 27 is pivotably connected with the free ends of both links 20 and 21 and corresponds to the distance between the pivot axles 22 and 23. The coupling member 27 is relatively short as compared with the links 20 and 21.

Two horizontal bushes 28 are mounted on the coupling member 27 under the latter. Only front bush can be seen in the drawing.

Rods 29 are slidingly guided in the bushes 28 so that they are reciprocable in a horizontal direction. A handle 30 and a holding plate 31 are connected with the rods 29. A bent end of a rod 32 is mounted on the holding plate 31. A supporting element 33 is arranged on another vertically upwardly extending leg of the rod 32 and serves for supporting the nozzle set 4.

The supporting element 33 has a substantially square horizontal table 34. The table 34 is connected by screws at its lower side with a substantially smaller rectangular plate 35. THe rectangular plate 35 is welded as a flange to an end of a tubular piece 36. The tubular piece 36, in turn, is fitted on the rod 32 and is arrested on this rod by an arresting formation 37 engageable in a not shown depression in the rod 32.

Screws 38 are screwed in the vicinity of the two diagonally opposite corners of the table 34. Their heads form raised formations 39 at the upper side of the table. The arrangement of the screws 38 and the dimensions of the screw heads, correspond to depressions 40 at the lower side of the nozzle set 4. The depressions 40 are formed so that the screws 41 with which the nozzle set 4 is screwed together do not fill the associated threaded openings completely to their lower ends.

A plate 42 is mounted under the table 34 with spacer screws 43. The plate 42 has a rectangular opening 45 approximately in its center. The length of the opening is somewhat greater than the length of the rectangular plate 35 and its longitudinal sides slidingly abut against the longitudinal sides of the rectangular plate 35.

The rectangular plate 35 serves as a guide for the plate 42 which reciprocates in direction of the longitudinal openings 44. For reasons which will be explained herein below, the position of the plate 42 shown in FIGS. 3 - 6 is identified as a ready position. Another position which is not shown in the drawing and in which the plate 42 is displaced to the right is identified as a locking position. An arresting formation 46 is mounted at the lower side of the plate 42 and extends through an opening in the plate 42 selectively into an opening 47 or into an opening 48 of the table 34. In correspondence with this, the plate 42 is arrested both in the ready position and in the locking position.

Hook bolts 49 are mounted on the plate 42 at opposite sides in the vicinity of the edge. They extend through elongated openings 50 of the table 34. The nozzle set 4 is provided at its lower side with openings 51 arranged at respective points and undercut behind a projection 52.

Figure 3:
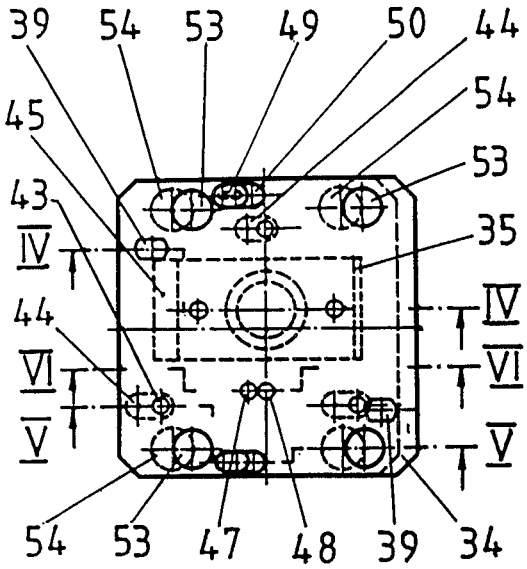
FIG. 3 is a view showing a table of a supporting element on a plan view from above.
Figure 4:
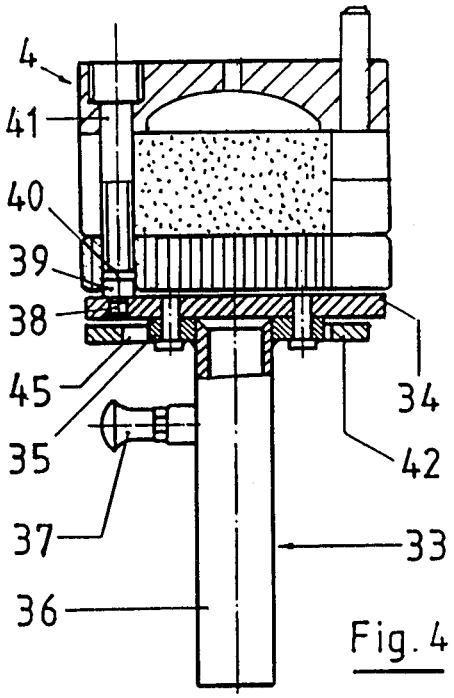
FIG. 4 is a view showing a section taken along the line IV—IV in FIG. 3.
Figure 5:
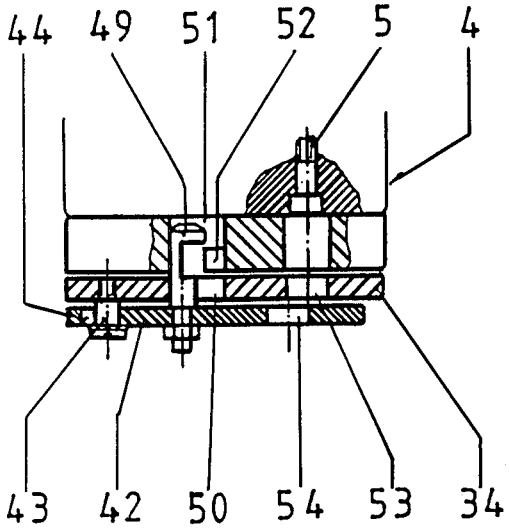
FIG. 5 is a view showing a section taken along the line V—V in FIG. 3.
Figure 6:
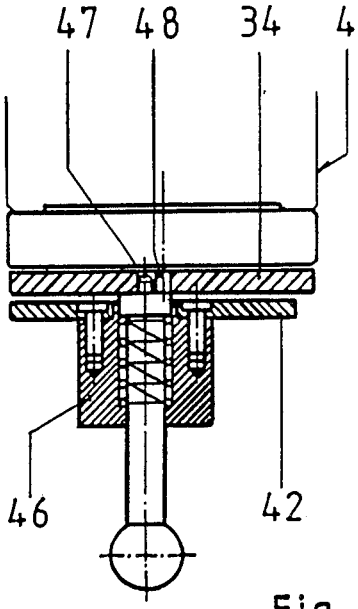
FIG. 6 is a view showing a section taken along the line VI—VI in FIG. 3.

Both the table 34 and the plate 42 is provided near the corners with four openings 53 and 54. The openings 53 of the table 34 correspond to the openings 55 in which the screws 5 are located for mounting the nozzle set 4 on the spinning bar 3. The openings 53 of the table 34 and the openings 54 of the plate 42 are offset relative to one another in the ready position, as shown in FIG. 3 and in FIG. 5. They are in alignment with one another in the locking position.

In operation, the carriage 15 stands advantageously on the part of the rail 13 and particularly on their part which extends outwardly beyond the end of the spinning bar 3, so that it does not interfere with the operation of the blowing channel. When the nozzle set must be exchanged, it is moved first on the rail 13 for such a distance that it is located opposite to the nozzle set. Then the arm 19 is turned from the normal position to the working position. The free end of the arm 19 now extends into the blowing channel 10 and the table is located under the nozzle set 4. An accurate positioning is performed with the handle 30 so that the raised portions 39 formed by the screw heads engage in the depressions 40. Simultaneously the hook bolts 49 engage into the recesses 51. Subsequently, after releasing the arresting formation 46, the plate 42 is brought in the locking position. The hook bolt 49 engage behind the projections 52 and simultaneously the openings 54 are brought in alignment with the openings 53. The engaging formation 52 snaps into the opening 48. With the aid of a socket with extending through the openings 53 and 54, the screws 5 can now be released. After this, the arm 19 with the nozzle set 4 resting on it can be turned back to the normal position.

During dismounting of the nozzle set 4, it is convenient that the blowing channel 10 under the supporting element 33 is freely available. The arrangement described in connection with FIGS. 3–6 guarantees that the nozzle set 4 can be released first when it lies orderly on the table 34 and secured against lateral sliding and unauthorized lifting. The hook bolts 49 allows to tear off the glued nozzle set after releasing of the screws 5. The U-shaped cross-section of the rail 13 prevents tilting of the carriage 15.

Mounting of a new nozzle set is performed in a reverse order. If the nozzle set is utilized with another form or size, only the supporting element 33 must be exchanged.

It will be understood that each of the elements described above, or two or more together, may also find a useful application in other types of constructions differing from the types described above.

While the invention has been illustrated and described as embodied in an arrangement melt spinning of synthetic high polymers, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. An arrangement for melt spinning of synthetic high polymers, comprising a spinning bar extending in a predetermined direction; a nozzle set inserted in said spinning bar and located at a predetermined height; means for exchanging said nozzle set, said exchanging means including rails extending parallel to said spinning bar at a height corresponding to said predetermined height of said nozzle set, a carriage suspended on said rails and movable on said rails, an arm having a free end and mounted on said carriage for movement between a normal position and a working position, and a supporting element arranged on said free end of said arm and movable in said working position to said nozzle set inserted in said spinning bar, said arm being formed as a parallel guide and includes two links pivotally connected with said carriage and a connecting member connected with said supporting element.

2. An arrangement as defined in claim 1, and further comprising a rod connected with said connecting member and displaceable parallel to the latter, said supporting element being arranged on said rod.

3. An arrangement as defined in claim 2, wherein said supporting element and said rod are connected with one another by a releasable connection.

4. An arrangement for melt spinning of synthetic high polymers, comprising a spinning bar extending in a predetermined direction; a nozzle set inserted in said spinning bar; means for exchanging said nozzle set, said exchanging means including rails extending parallel to said spinning bar, a carriage movable on said rails, an arm having a free end and mounted on said carriage for movement between a normal position and a working position, and a supporting element arranged on said free end of said arm and movable in said working position to said nozzle set in said spinning bar; and centering elements provided on said supporting element and said nozzle set and corresponding to one another.

5. An arrangement as defined in claim 4, wherein said supporting element has a table provided with at least one raised formation, said nozzle set having a lower side and being provided at said lower side with a depression corresponding to said raised formation of said table, said raised formation and said depression forming said centering means.

6. An arrangement for melt spinning of synthetic high polymers, comprising a spinning bar extending in a predetermined direction; a nozzle set inserted in said spinning bar; means for exchanging said nozzle set, said exchanging means including rails extending parallel to said spinning bar, a carriage movable on said rails, an arm having a free end and mounted on said carriage for movement between a normal position and a working position, and a supporting element arranged on said free end of said arm and movable in said working position to said nozzle set inserted in said spinning bar; and locking elements provided on said supporting element and said nozzle set and corresponding to one another.

7. An arrangement as defined in claim 6, wherein said nozzle set has a lower side and is provided at said lower side with an undercut recess, said supporting element including a table having a hook bolt displaceable relative to said table and engageable into said recess, said recess and said hook bolt forming said locking means.

8. An arrangement as defined in claim 7 and further comprising a plate which is slidingly guided relative to said table and carries said hook bolts, said table being provided with openings and said plate being also provided with openings which are in alignment with said openings of said table in a locking position of said table.

9. An arrangement as defined in claim 6, wherein said locking elements are arrestable.

10. An arrangement as defined in claim 9, wherein said supporting element having a table with two openings; and further comprising an arresting pin connected with said plate and selectively springly engageable in one of said two openings so as to form said locking means.

11. An arrangement for melt spinning of synthetic high polymers, comprising a spinning bar extending to a predetermined direction; a nozzle set inserted in said spinning bar and having a lower side; means for exchanging said nozzle set, said exchanging means including rails extending parallel to said spinning bar, a carriage movable on said rails, an arm having a free end and mounted on said carriage for movement between a normal position and a working position, and a supporting element arranged on said free end of said arm and movable in said working position to said nozzle set inserted in said spinning bar; and screws which are screwed into said nozzle set from said lower side and mount said nozzle set on said spinning bar, said supporting element being provided with openings for insertion of a tool for releasing said screws, and said openings being blocked in a ready position and open in a locking position of said table.

* * * * *